US006752547B2

(12) United States Patent
Britcher et al.

(10) Patent No.: US 6,752,547 B2
(45) Date of Patent: Jun. 22, 2004

(54) LIQUID DELIVERY SYSTEM AND METHOD

(75) Inventors: Eric B. Britcher, Rancho Cucamonga, CA (US); Y. Sean Lin, Irvine, CA (US); Ricardo Martinez, Apple Valley, CA (US); Leonard Giarto, Los Angeles, CA (US)

(73) Assignee: Applied Materials Inc., Santa Clara, CA (US)

( * ) Notice: Subject to any disclaimer, the term of this patent is extended or adjusted under 35 U.S.C. 154(b) by 24 days.

(21) Appl. No.: 10/282,770

(22) Filed: Oct. 28, 2002

(65) Prior Publication Data

US 2004/0081457 A1 Apr. 29, 2004

(51) Int. Cl.[7] ..... G03D 3/02; G03D 5/00

(52) U.S. Cl. ..... 396/626; 396/578; 396/611; 396/632

(58) Field of Search ..... 396/578, 611, 396/625, 626, 632, 638

(56) References Cited

U.S. PATENT DOCUMENTS 5,258,796 A * 11/1993 Patterson ..... 396/572

6,517,261 B1 * 2/2003 Piccinino et al. ..... 396/571

FOREIGN PATENT DOCUMENTS

JP 5-216241 * 8/1993

* cited by examiner

*Primary Examiner*—Alan Mathews
(74) *Attorney, Agent, or Firm*—Moser, Patterson & Sheridan

(57) ABSTRACT

Embodiments of the invention provide a liquid delivery system. The liquid delivery system generally includes a plurality of vessels flexibly coupled to a frame to provide vibration isolation therefrom. In one embodiment, the liquid delivery system includes tubing coupling liquids to/from the plurality of vessels, wherein the tubing is selected to minimize the transmission of mechanical noise to the plurality of vessels. In another embodiment, the liquid delivery system includes a controller adapted to monitor and control the delivery of the liquids throughout the system. In another embodiment, a method is provided to deliver liquids from storage vessels to substrate processing systems. Generally, the liquid delivery is completed using a first delivery step and a second delivery step wherein the amount of liquid delivered during the second delivery step is determined using the amount of liquid delivered from the first delivery step and controller by time to minimize the impacts of signal noise and delivery delay.

42 Claims, 10 Drawing Sheets

LIQUID DELIVERY SYSTEM AND METHOD

BACKGROUND OF THE INVENTION

1. Field of the Invention

Embodiments of the invention generally relate to semiconductor processing, and more particularly to apparatus and method for delivery of liquid chemicals within substrate processing systems.

2. Description of the Related Art

A chip manufacturing facility is composed of a broad spectrum of technologies. Cassettes containing semiconductor substrates are routed to various stations in the facility where they are either processed or inspected. Semiconductor processing generally involves the deposition of material onto and removal ("etching") of material from substrates. Typical processes include chemical vapor deposition (CVD), physical vapor deposition (PVD), electro-chemical plating, chemical mechanical planarization (CMP), etching, cleaning, and others. Of the above process, approximately 25% involve liquid chemical processes.

One issue regarding semiconductor processing involves the accurate delivery of liquid chemicals to tightly control the chemical concentrations within a process solution such as photoresist. Conventional liquid delivery systems take chemicals from bulk supplies, local reservoirs, or bottles and deliver them using a metering pump and/or flow meter. Metering pumps are prone to particle generation and require periodic service and calibration. There are various flow meter technologies available to measure the amount of liquid dispensed. Most are unable to provide accurate measurement for small volumes or very low flow rates. With the exception of technology employing the Coriolis effect, all are prone to error from viscosity changes, backpressure fluctuation, liquid color, temperature fluctuation, or air bubbles in the supply line. Differential pressure technology has been successfully used at low flow rates but requires a small orifice that is incompatible with some abrasive solutions. Coriolis technology is capable of more accurate mass flow measurement and is less affected by the issues listed above. However, it is a more expensive delivery method.

Substrate processing generally requires that liquid chemicals must be delivered in precise amounts on demand, be free of bubbles, be of a uniform thickness on the usable part of the substrate and minimize chemical waste due to cost and environmental concerns. Unfortunately, conventional precision liquid delivery is prone to errors due to measurement noise and liquid measurement uncertainties. Generally, liquid delivery systems are prone to noise from a variety of sources, including vibration and thermal changes. In addition, measurement noise from liquid detectors used to detect liquid levels and flow rates may contribute to the signal to noise ratio (SNR). The SNR generally limits the system measurement resolution and, therefore, the liquid delivery precision. Liquid measurement inaccuracies may also be caused by other factors such as liquid resistance within the delivery system. For example, the chemicals may partially adhere to tubing used to deliver the liquid causing resistance to liquid movement. Further, as chemicals move through the delivery system they may pick up residual chemicals from a previous processing and/or add or subtract liquid, thereby altering the delivery amount.

Air in the delivery system may also cause delivery inaccuracies. It is desirable to completely use the contents of a chemical bottle without introducing air bubbles into the delivery line. One method is to place a reservoir between the chemical bottle and the metering device, In the case of a pressurized chemical bottle, this reservoir can be periodically vented in order to remove air pockets from the system. For a non-pressurized bottle, a vacuum is typically drawn on the reservoir. Typically, a bubble sensor is used to detect air in the liquid delivery system to minimize the risk of introducing bubbles into the chemicals during chemical delivery or refill. The bubble sensor is also generally used to detect when the reservoir is empty, thus allowing the liquid delivery system to switch to a different reservoir. However, bubble sensors are often prone to errors as air bubbles introduced into the system may trigger a false empty signal. Thus, not all of the chemical may be used before the system switches to the next reservoir.

Therefore, there is a need for a liquid delivery system configured to provide controllable liquid delivery, improved liquid delivery precision, and increased liquid utilization.

SUMMARY OF THE INVENTION

Embodiments of the invention generally provide a liquid delivery system configured to provide precise delivery of liquid chemicals used in semi-conductor processing. In one embodiment, the invention provides an apparatus for delivering liquids to substrate processing systems including a frame, a plurality of load cells extending from the frame, each adapted to output signals corresponding to the liquid input and output of the apparatus, and a plurality of free hanging vessels. Each vessel is suspended from one of the plurality of load cells. Each of the plurality of free hanging vessels including at least one gas input, at least one liquid input, and at least one liquid outlet, and at least one vibration dampener disposed between each of the plurality of load cells and each of the plurality of free hanging vessels hanging therefrom, to minimize the transmission of vibration therebetween.

In another embodiment, the invention provides a liquid delivery system adapted to deliver one or more liquids to substrate processing systems. The system includes a plurality of free hanging vessels vibrationally isolated from a frame, a plurality of load cells disposed on the frame, each having one of the plurality of free hanging vessels hanging therefrom, wherein each of the plurality of load cells is adapted to output one or more signals corresponding to a weight of the one free hanging vessel attached thereto. The system also includes at least one vibration dampener positioned between the frame and each of the plurality of load cells to isolate vibration transmission therebetween. The system further includes a controller electrically coupled to the plurality of load cells and adapted to process the one or more signals therefrom to control the liquid flow of the liquid delivery system.

In another embodiment, the invention provides determining a method of delivering liquids to a substrate processing system including determining a total fluid amount to deliver, determining a first system response to compensate for system noise during liquid delivery, and determining a first liquid amount to deliver from at least one of a plurality of vessels fluidly coupled to the substrate processing system. The first liquid amount to deliver corresponds to a first deliver time associated with a delivery rate and the first system response. The method includes delivering the first liquid amount to the substrate processing system then determining a second liquid amount to deliver to the substrate processing system based on the first liquid amount delivered thereto and the delivery rate, where the second liquid amount delivered corresponds to a second delivery time.

Then delivering the second liquid amount to the substrate processing system, wherein the summation of the first liquid amount delivered and the second liquid amount delivered is within a range of the total fluid amount to be delivered.

A method of delivering liquids from liquid sources to one or more substrate processing systems using a liquid delivery apparatus, including providing at least one signal to a controller from a load cell corresponding to a weight of the vessel, then processing the at least one signal to determine a first system response. The first system response based on at least one of system noise and a system delivery error during liquid delivery. The method includes delivering a first liquid amount for a first delivery time at a delivery rate, and delivering a second liquid amount for a second delivery time based on the first liquid amount delivered, wherein the first liquid amount delivered and second liquid amount delivered total to within a range of a specified liquid delivery amount.

BRIEF DESCRIPTION OF THE DRAWINGS

So that the manner in which the above recited features of the invention are attained can be understood in detail, a more particular description of the invention, briefly summarized above, may be had by reference to the embodiments thereof, which are illustrated in the appended drawings. It is to be noted, however, that the appended drawings illustrate only typical embodiments of this invention, and are therefore, not to be considered limiting of its scope, for the invention may admit to other equally effective embodiments.

DETAILED DESCRIPTION OF THE PREFERRED EMBODIMENT

Figure 1:
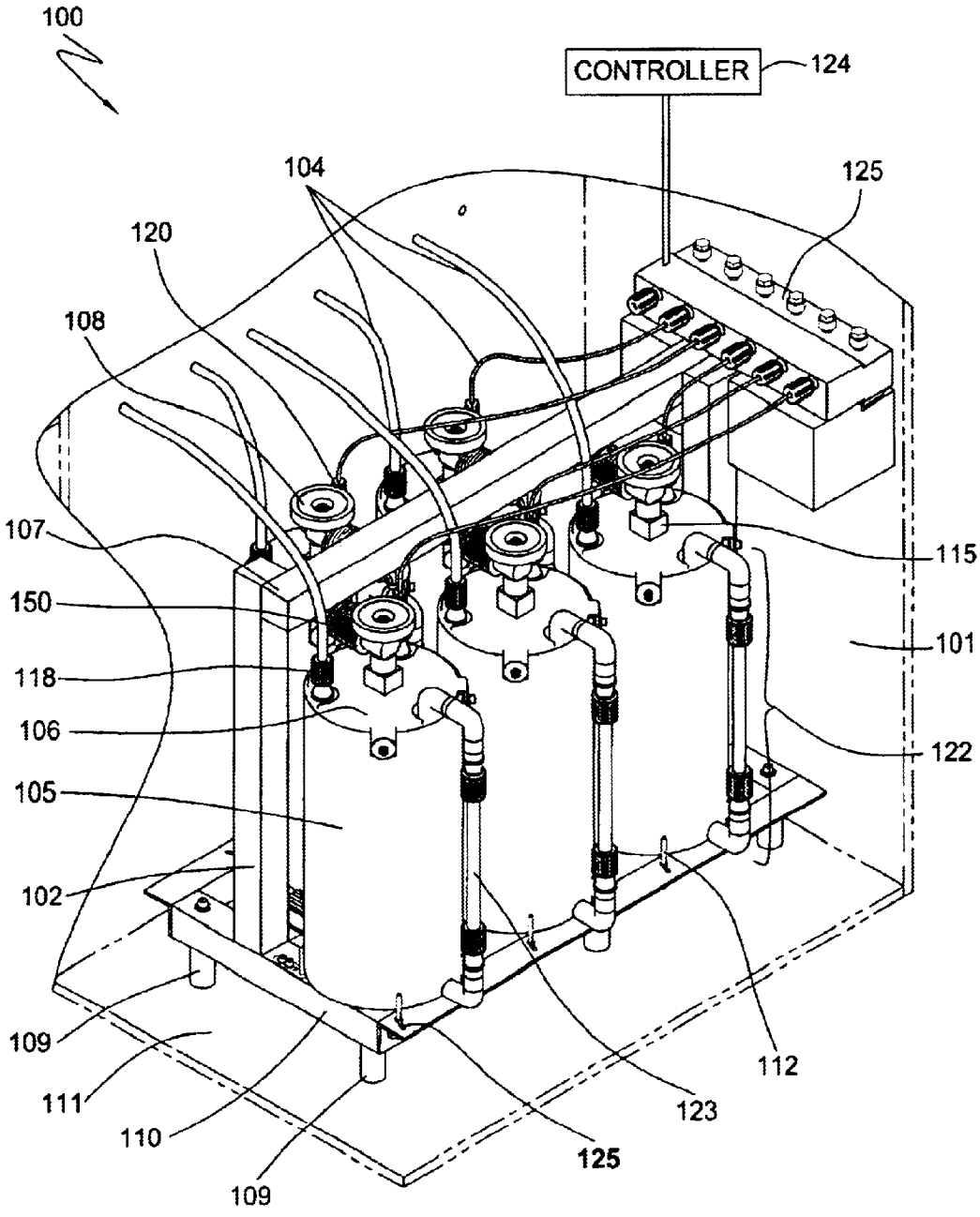
FIG. 1 is a perspective view of a one embodiment of a liquid delivery apparatus that may be used to advantage.

FIG. 1 illustrates a perspective view of an exemplary liquid delivery system 100 of the invention. System 100 generally includes a plurality of vessels 105 (five are shown) adapted to hold liquid chemicals therein for use with substrate processing systems. The vessels 105 may be formed from material such as plastics or other materials compatible with the liquid chemicals. The vessels 105 may be mounted to a frame 102 that may be formed from rigid materials such as aluminum, stainless steel, or other materials, sufficiently rigid to hold the weight of the vessels 105 and any liquid therein. The frame may also include any material having a coating chemical compatibility with the liquid chemicals. The frame 102 includes a base 110 adapted to support the frame 102 and vessels 105 disposed thereon. The frame 102 includes a plurality of isolation supports 109 disposed between the base 110 and a horizontal support surface 111, such as a table or cabinet The isolation supports 109 are adapted to minimize the vibration between the frame 102 and the horizontal support surface 111 and may include flexible materials such as neoprene, rubber, ethylene propylene diene monomer (EDPM), stainless steel coupling, wire coils, soft gel, frame pneumatic vibration dampers, and the like. The frame 102 may be supported within an enclosure 101 adapted to protect the system 100 from an external impact. The vessels 105 may be connected to external liquid sources and/or gas sources via a plurality of interconnect tubing 104 extending through the enclosure 101 as well as to valves and other liquid control devices described herein. The interconnect tubing 104 may include a flexible structure, wall thickness, and a diameter sized to minimize vibration transmission therethrough, and avoid suspending the vessels 105 discussed further herein.

In order to allow the vessels 105 to hang freely, the vessels 105 are suspended from load cells 150 extending laterally from an upper bar member 107 of the frame 102. The bar member 107 may be adapted to support the vessels 105 and may supply some vibration isolation from the base 110 of the frame 102. To isolate the vessels 105 from vibration and twisting, each load cell 150 may be coupled to a vibration dampener 115 disposed between the load cell 150 and a mounting plate 106 disposed on an upper portion of the vessel 105. A plurality of stop pins 112 may be used to minimize the horizontal travel of the vessel 105 while allowing the vessel 105 to travel freely between one or more vertical positions. The stop pins 112 may be arranged about the vessel 105 in any arrangement adapted to limit the horizontal travel of the vessel 105. The stop pins 112 may also be adjustable so that if the vessel 105 and/or frame 102 are tilted, the stop pins 112 may be adjusted to minimize contact with the vessel 105. The stop pins 112 may be slidably coupled to a mating slot 125 adapted to allow the stop pin 112 to be adjusted but maintain a rigid position relative the vessel 105. In one aspect, the stop pins 112 may include a set of horizontal bristles or foam (not shown) adapted to minimize the horizontal movement of the vessel 105 while generally allowing free vertical movement.

The system 100 may include a process controller 124 in order to control one or more liquid delivery functions and measurements. In one aspect of the invention, the process controller 124 may include a computer or other controller adapted to analyze and display data input/output signals of the system 100, and may display the data on an output device such as a computer monitor screen. In general, the process controller 124 includes a controller, such as programmable logic controller (PLC), computer, or other microprocessor-based controller. The process controller 124 may include a central processing unit (CPU) in electrical communication with a memory, wherein the memory may contain a liquid delivery program that, when executed by the CPU, may provide control for at least a portion of the system 100. The liquid delivery program may conform to any one of a number of different programming languages. For example, the program code can be written in PLC code (e.g., ladder logic), object oriented program code such as C, C++, Java, or a number of other languages. As such, the process controller 124 may receive inputs from the various components of the system 100 and generate control signals that may be transmitted to the respective components of the system 100 for controlling the operation thereof.

Figure 2A:
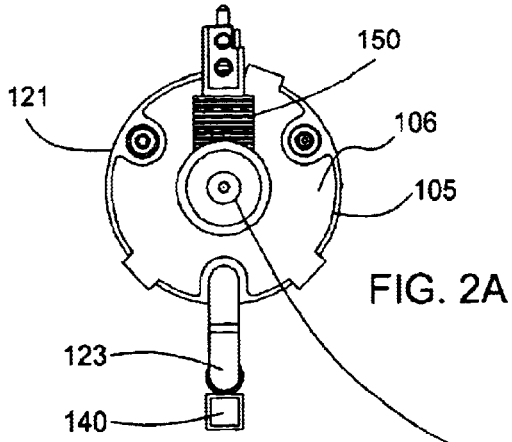
FIGS. 2A. 2B, and 2C are a top, side, and sectional views, respectively, of one embodiment of the vessel from FIG. 1.
Figure 2B:
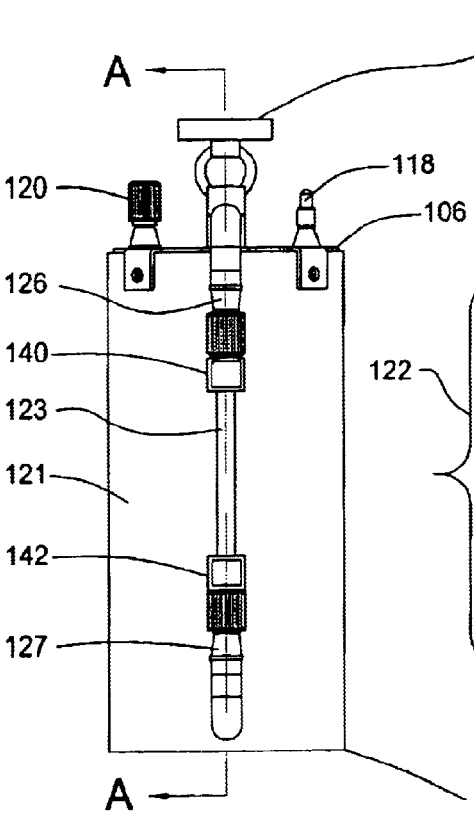
Figure 2C:
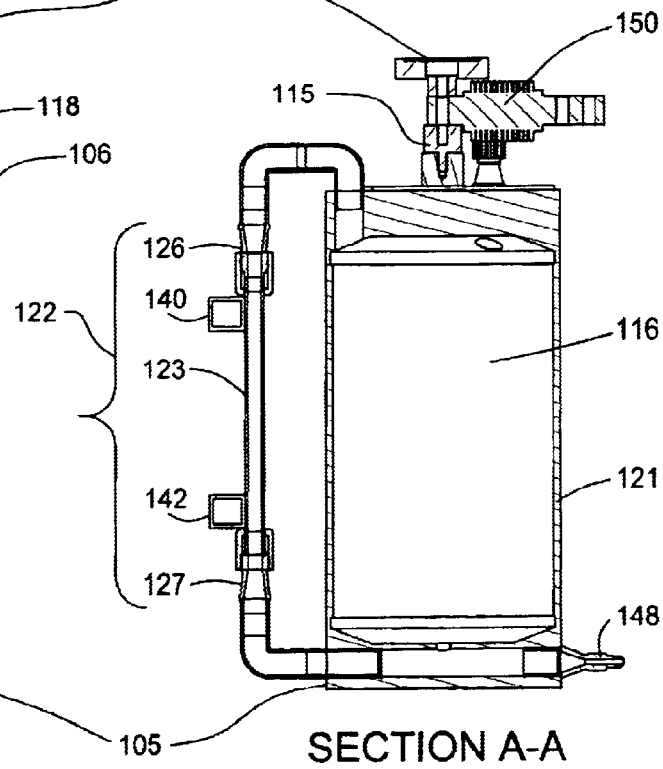

As shown in FIGS. 2A, 2B, and 2C, the vessel 105 includes an outer shell 121 surrounding an inner cavity 116 to hold liquids therein. The shell 121 may be made of materials such as plastics and/or metals compatible with the chemical liquids and gasses. In one aspect, each vessel 105 includes a gas input/output 118 and a liquid input 120. To minimize vibration the gas input/output 118 is generally smaller than the liquid input 120 to allow smaller tubing to be attached thereto. The vessel 105 also has a liquid outlet 148 adapted to dispense liquids from the cavity 116 to an external substrate processing system explained further herein with respect to FIGS. 3 and 4.

Each vessel 105 may include a liquid level monitor 122 to display the level of liquid therein. The liquid level monitor 122 may be adapted to allow the use of level sensors 140, 142 described below to detect the level of liquid within the vessel 105. In one aspect, the liquid level monitor 122 may include a clear tube segment 123 to provide a view of the liquid within the vessel 105 without touching the vessel 105. The dear tube segment 123 may be coupled to the vessel 105 on an upper end, via an upper coupling 126, and to a lower coupling 127. While it is contemplated that the clear tube segment 123 may be formed from a variety of tube diameters, it is believed that the diameter should be sized large enough to overcome liquid segmentation under vacuum conditions. For example, for a very small diameter dear tube segment 123, under vacuum the liquid may break up into small segments, e.g., slugs, that may adversely affect the level check.

Figure 3:
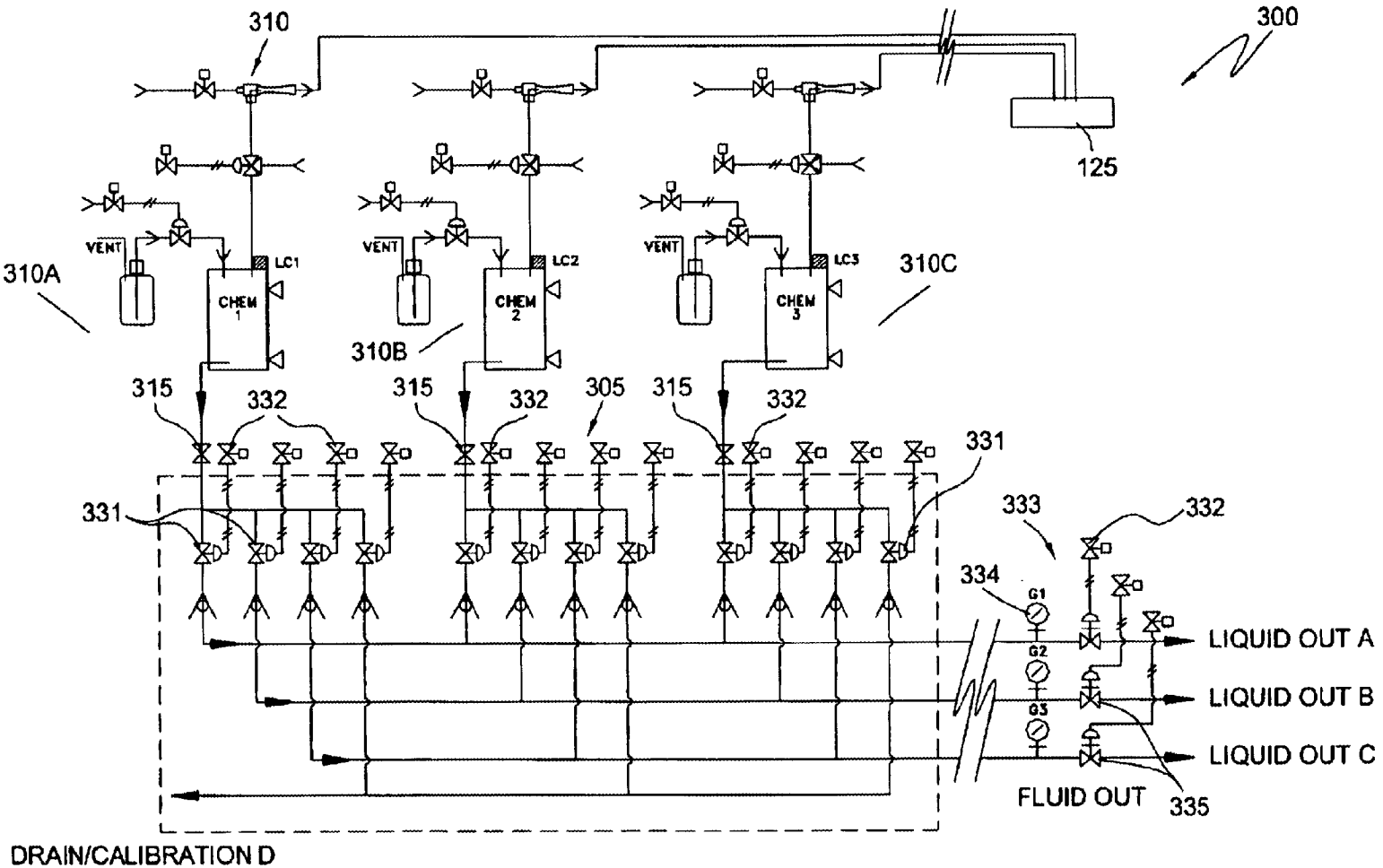
FIG. 3 is a schematic of one embodiment of a liquid delivery system for use with aspects of the invention.

For calibration purposes, a calibration weight holder 108 may be disposed on the load cell 150 on a side opposite the vibration dampener 115. The calibrated weight holders 108 may be used to hold one or more calibrated weights thereon. The calibrated weights may be used to determine the measurement accuracy of the load cells 150. The addition of the calibrated weight could be used to determine if the load cells 150 are functioning within a predefined limit. A change in weight measured before and after adding a calibrated weight should about correspond to the weight of the calibrated weight A.—Liquid Delivery System FIG. 3 is a schematic of one embodiment of a liquid delivery system 300. FIG. 3 illustrates three liquid delivery sub-systems 310A–C, further described in FIG. 4 below, coupled to a liquid manifold 305 adapted to receive liquids from one or more liquid delivery sub-systems 310A–C, combine liquids, and deliver the liquid mixtures to one or more substrate processing systems (not shown). In one aspect, a flow constriction 315 is used to allow either manual and/or automatic flow control for liquids from the liquid delivery sub-systems 310A–C to the liquid manifold 305.

In order to intermix numerous liquids for processing, the outputs of a plurality of individual sub-systems 310 may be ganged together, wherein each sub-system 310 is adapted to input a portion of the liquid used for substrate processing. FIG. 3 illustrates three sub-systems 310A–C connected to the liquid manifold 305. The liquid manifold 305 receives liquids from each sub-system 310A–C, and then dispenses the liquids to an appropriate liquid output A–D. For example, depending on which liquid connection valves 331 are selected using one or more air actuation valves 332, subsystem 310A may deliver a first liquid to liquid output A, B, C, and/or D where D may be a drain or volumetric calibration port. The liquids from the output of each subsystem 310A–C may be dispensed to one or more of the liquid outputs A–C, via output valves 335.

B.—Liquid Delivery Sub-System

Figure 4:
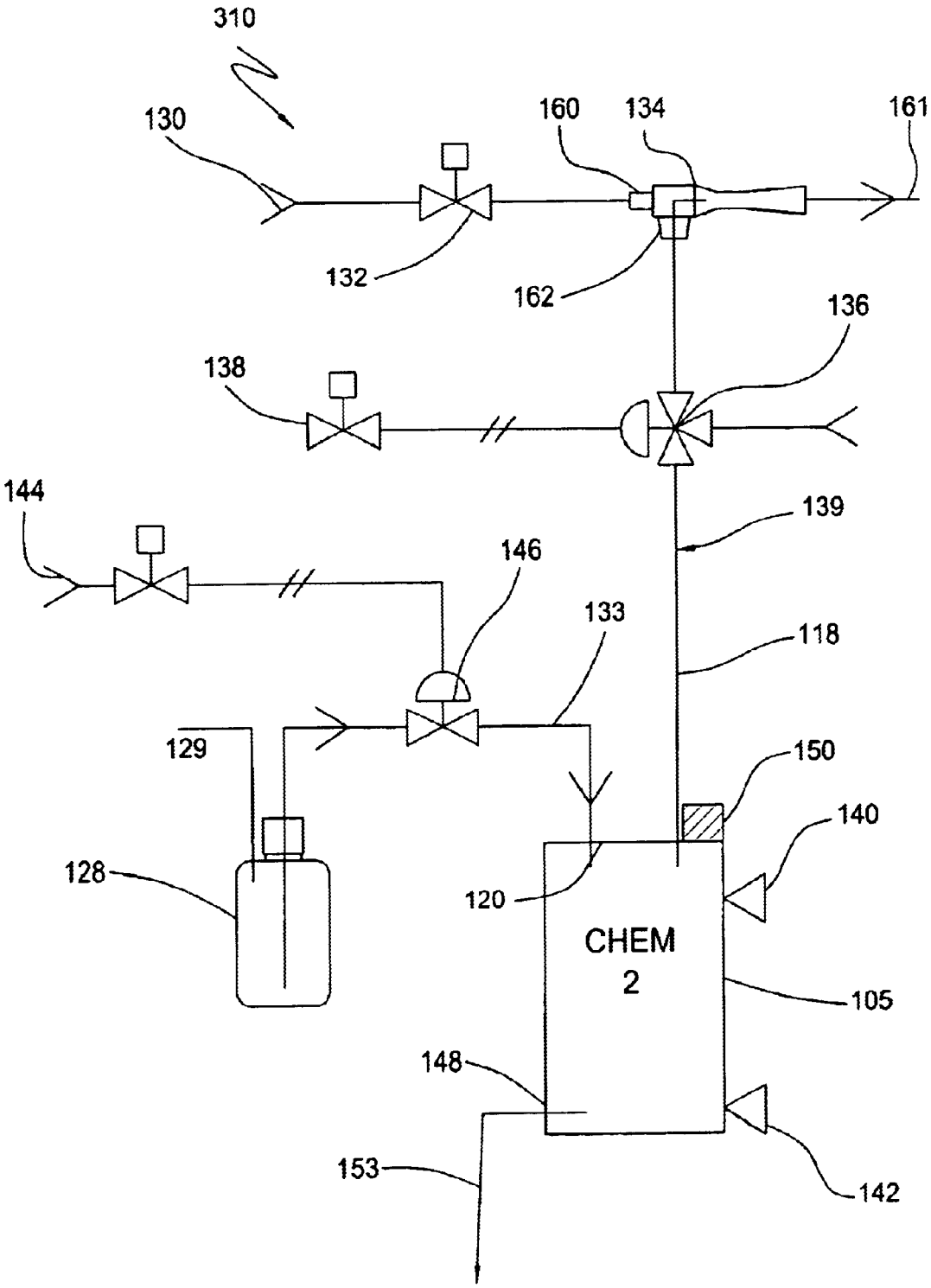
FIG. 4 is a schematic of one section of the liquid delivery system of FIG. 3.

FIG. 4 illustrates an embodiment of a liquid deliver sub-system 310. Each liquid delivery sub-system 310 is adapted to couple one or more liquid sources 128 to the vessel 105, measure the amount of liquid delivered, and deliver the liquid in a metered amount to the liquid manifold 305 (see FIG. 3). The liquid sources 128 may comprise a vent 129 to equalize pressure within the liquid source 128 during a fill process. The vent 129 may also be used to couple an external air pump (not shown) configured to provide an pressurize the liquid source 128 to help deliver the fluid from the liquid source 128 to the vessel 105 as described below. The liquid delivery sub-system 310 may include a liquid input valve 146 to control the flow of liquids from the liquid source 128 to the vessel 105 via fill tubing 133 coupled to fluid input 120. The fill tubing 133 may be formed of flexible materials such as PTFE, vinyl, and other plastic materials that are chemically compatible with the liquids while minimizing vibration transmission. Fill tubing 133 may be configured in any diameter, flexibility, and wall thickness that avoids suspending the vessel 105. In one aspect, the fill tubing 133 is sized at about ⅜" in diameter to allow for quick refill of vessel 105. Moreover, the fill tubing 133 may also be configured with a wall thickness sized to minimize vibration transmission while allowing the transport of liquids therein. The liquid input valve 146 may be activated using an input liquid solenoid 144. In one aspect, the liquid input solenoid 144 activates the liquid input valve 146 pneumatically, using air pressure sources such as clean dry air (CDA).

The liquid delivery sub-system 310 may also include a gas input valve 136 adapted to control the gas input into the vessel 105. In another aspect, the gas input valve 136 may be a multi input/output valve such as a three-way valve. In one configuration, during or following a liquid delivery step, the gas input valve 136 may direct an inert gas such as nitrogen from an external gas source (not shown) via gas tubing 139 to pressurize the vessel 105 for a liquid dispense process, for example. The gas tubing 139 may be formed of flexible materials such as PTFE, vinyl, and other plastic materials that are chemically compatible with the gases while minimizing vibration transmission. Depending on the amount of gas to deliver, the gas tubing 139 may be of any diameter capable of delivering a gas while minimizing vibration transmission and avoiding suspending the vessel 105. For example, in one aspect, the gas tubing 139 is sized at about ⅛". Vibration transmission is also diminished by using small diameter tubing, e.g., not more than ⅛" tubing. Moreover, the gas tubing 139 may also be configured with a wall thickness sized to minimize vibration transmission while allowing the transport of gases therein.

In another configuration, during a liquid fill step, the gas input valve 136 may couple a vacuum (i.e., a sub-ambient air pressure) from a venturi 134, to the vessel 105. The venturi 134 may include materials such as PTFE, PFA, PVC, and other materials chemically compatible with the gases. The venturi 134 may include an input port 160, an output port 161, and a vacuum port 162 liquidly coupled to the gas input/output 118 via gas input valve 136. The input port 160 may be adapted to receive CDA using a venturi activation valve 132. A vacuum is generated as the CDA moves from the input port 160 to the output port 161. While it is contemplated that the vessel vacuum may be generated using other means such as a vacuum pump, the venturi 134 is preferred, as it has no moving parts. The venturi 134 may also be configured as a vent to relieve pressure within the vessel 105 during a pressurized fill process when using a pressurized liquid source 128 as described above.

The liquid delivery sub-system 310 may also include an upper level sensor 140 and a lower level sensor 142 to sense the level of liquid held within the vessel 105. While, the upper level sensor 140 and a lower level sensor 142 may be selected from optical sensors configured to detect liquid within site tube 123, other sensors are contemplated such as magnetic, capacitive, inductive, and other types of sensors configured to detect liquids. The lower level sensor 142 may be used to indicate when liquid within the vessel 105 has reached a lower liquid level threshold. The lower level sensor 142 is configured to send an indication to process controller 124 that a lower liquid level threshold has been crossed both during a fill process as well as a dispensing process. The lower level sensor 142 may also be used to determine if a liquid has the proper specific gravity. For example, if the liquid filling the vessel 105 has a specific gravity that is lower than specified, the liquid delivery sub-system 310 may fill the vessel 105 with a greater amount of fluid than expected. The lower level sensor 142 may be configured to send,an indication to the process controller 124 when the liquid has crossed a specified fill level prior to an end of the fill process, thereby alerting the process controller 124 of an over fill and possibly an incorrect liquid.

The liquid delivery sub-system 310 may also include a liquid outlet 148 to discharge liquids from the vessel 105. The liquid outlet 148 may direct liquid from the vessel 105 to the liquid manifold 305, for example, via liquid outlet tubing 153. The liquid outlet tubing 153 may be formed of flexible materials, such as PTFE, vinyl, and other plastic materials that are chemically compatible with the liquids while minimizing vibration transmission. Depending on the amount of liquid to deliver, the liquid outlet tubing 153 may be of any diameter capable of delivering a liquid while minimizing vibration transmission and avoiding suspending the vessel 105. For example, in one aspect, the liquid outlet tubing 153 is sized at about ⅛". Vibration transmission is also diminished by using small diameter tubing, e.g., not more that ⅛", tubing. Moreover, the liquid output tubing 153 may also be configured with a wall thickness sized to minimize vibration transmission while allowing the transport of gases therein.

In operation, the sub-system 310 receives liquids from one or more outside liquid sources 128 and then dispenses those liquids in a metered amount to the processing systems. For example, in order to dispense liquids, the load cell 150 sends an analog signal, such as a current or voltage, corresponding to the weight of the vessel 105 to the process controller 124. The process controller 124 then determines the weight of the liquid in the vessel 105 and allows the liquid to be delivered until the weight of the vessel 105 has reached a predefined value indicative of the delivery of a desired liquid amount Before liquid dispensing, if the weight of the vessel 105 indicates that an adequate amount of liquid is available to dispense, then the vessel 105 need not be filled. However, if the vessel 105 weight is lighter than a predefined value, indicating that not enough liquid is available to dispense, the process controller 124 may activate the liquid input valve 146 in order to fill the vessel 105 from the external liquid source 128 to a desired level. As the vessel 105 is filled, the load cell signals change accordingly to the increased weight of the vessel 105. When the high level sensor 140 is on, the liquid input valve 146 is closed and the dispensing may begin. In one aspect, the venturi 134 may be activated by CDA, allowing a vacuum to be drawn from the vessel 105 via the gas input/output 118 to assist in the filing of the vessel 105.

During liquid dispensing, the vessel 105 may be vented or pressurized to equalize or increase/decrease the pressure changes within the vessel 105. In one aspect, an inert gas, such as nitrogen, may be used to pressurize the vessel 105. The liquids are dispensed via the liquid outlet tubing 153. As the liquids are dispensed from the vessel 105, the weight of the vessel 105 changes accordingly. In one aspect, the process controller 124 may use a liquid delivery program as described below in reference to FIG. 9, to analyze changes in the load cell weight measurements to accurately determine the amount of liquid delivered. In one aspect, process controller 124 can execute a refill of vessel 105 if lower level sensor 142 no longer detects liquid in vessel 105.

C.—Method of Controlled Liquid Delivery

Figure 9:
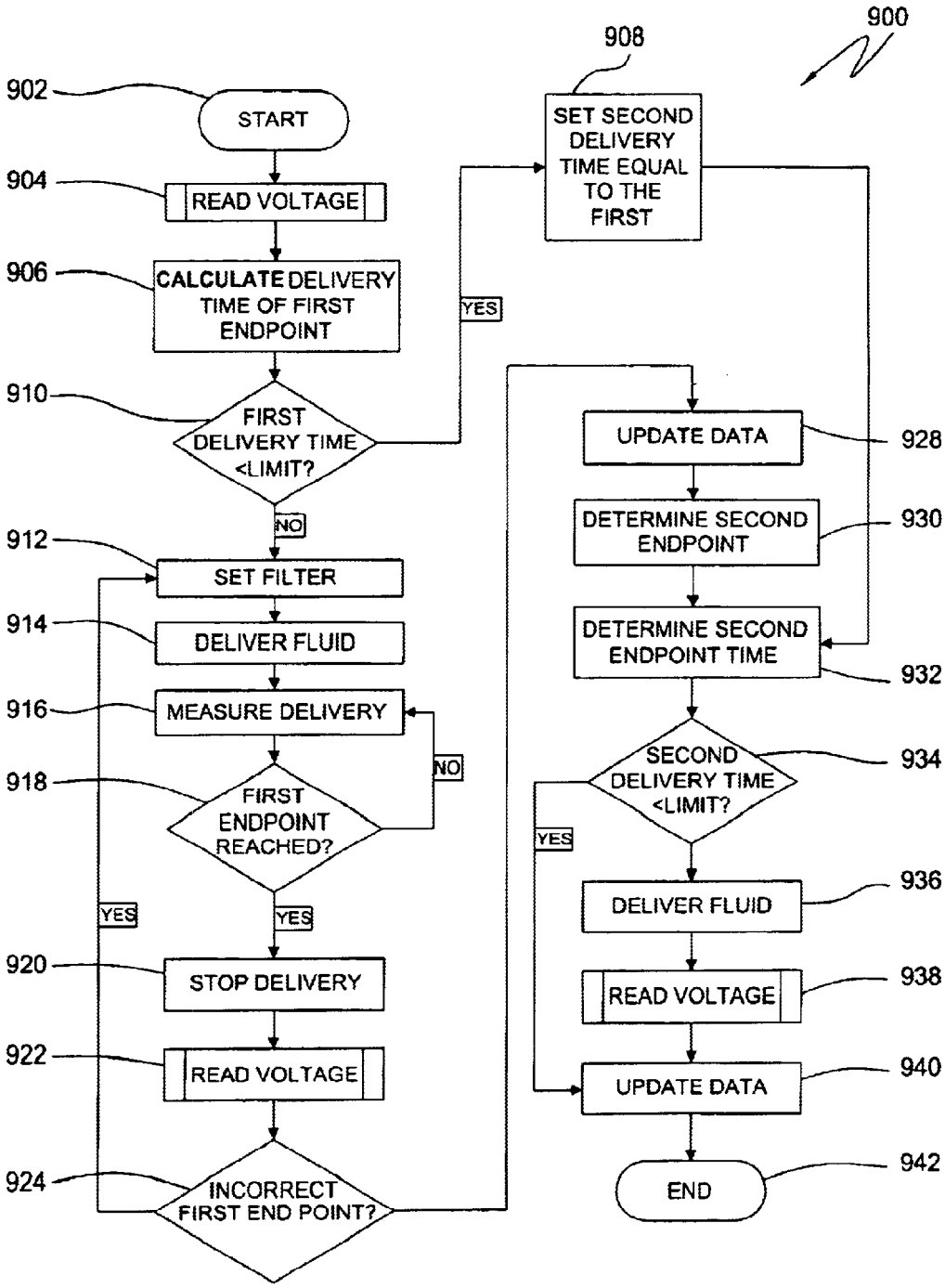
FIG. 9 is a flow diagram illustrating one embodiment of a liquid delivery process for use with aspects of the invention.

FIG. 9 illustrates a flow diagram of a method 900 to deliver an amount of liquid from a liquid dispensing system. For purposes of darity, method 900 will reference system 100 described herein as needed, however method 900 may be used with other liquid delivery systems. Generally, the method 900 provides at least one liquid dispensing step to provide an accurate liquid delivery. In one configuration, the method 900 performs a first liquid delivery, and then performs a second liquid delivery to provide a total delivery amount. In one aspect, the system 100 in combination with the method 900, provides feedback controlled fluid delivery, wherein the response of the fluid delivery system 100 is related to the load cell 150 signal output and processing thereof.

Figure 5:
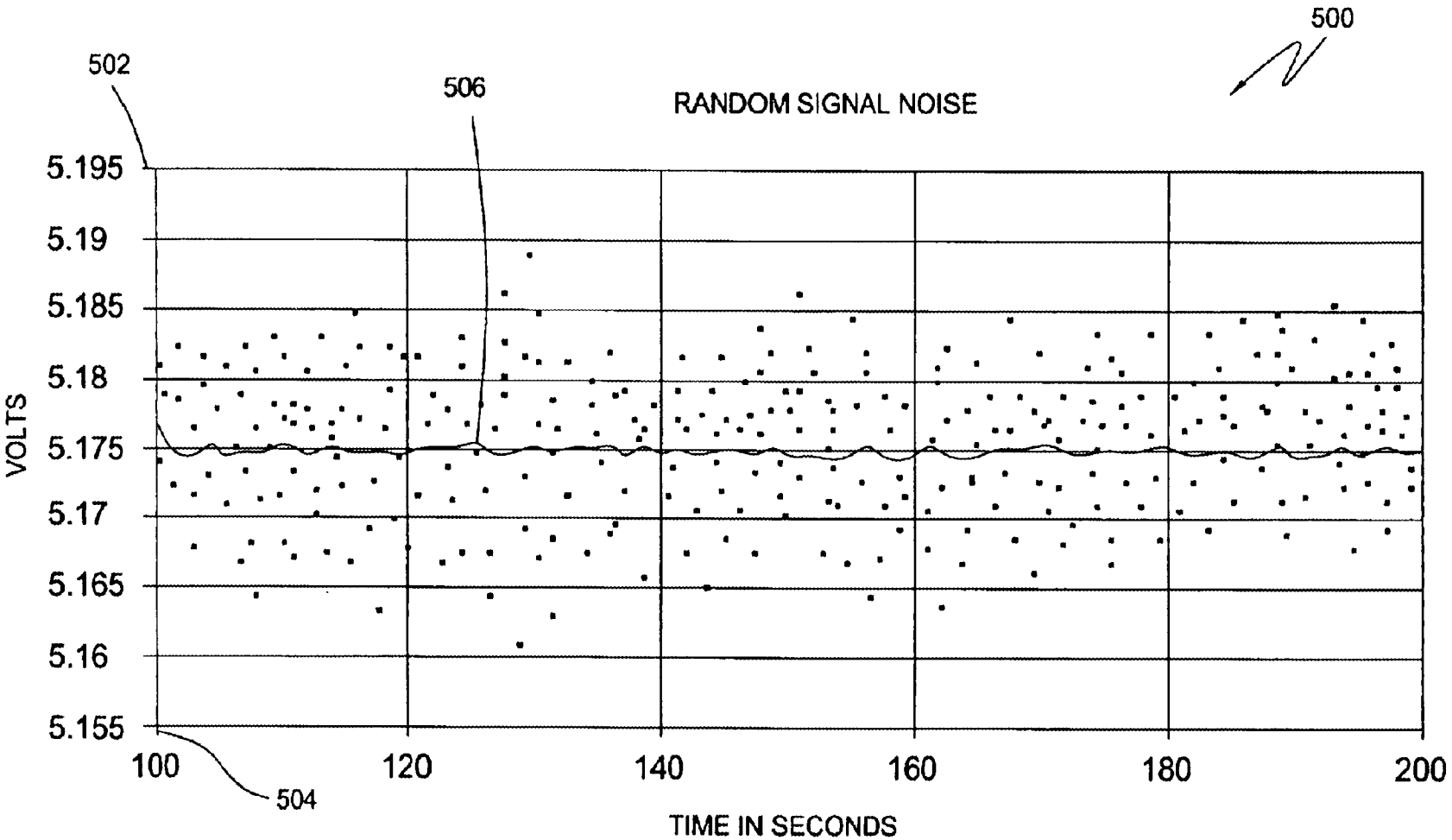
FIG. 5 is a graph illustrating measured system noise of a liquid delivery system for use with aspects of the invention.
Figure 8:
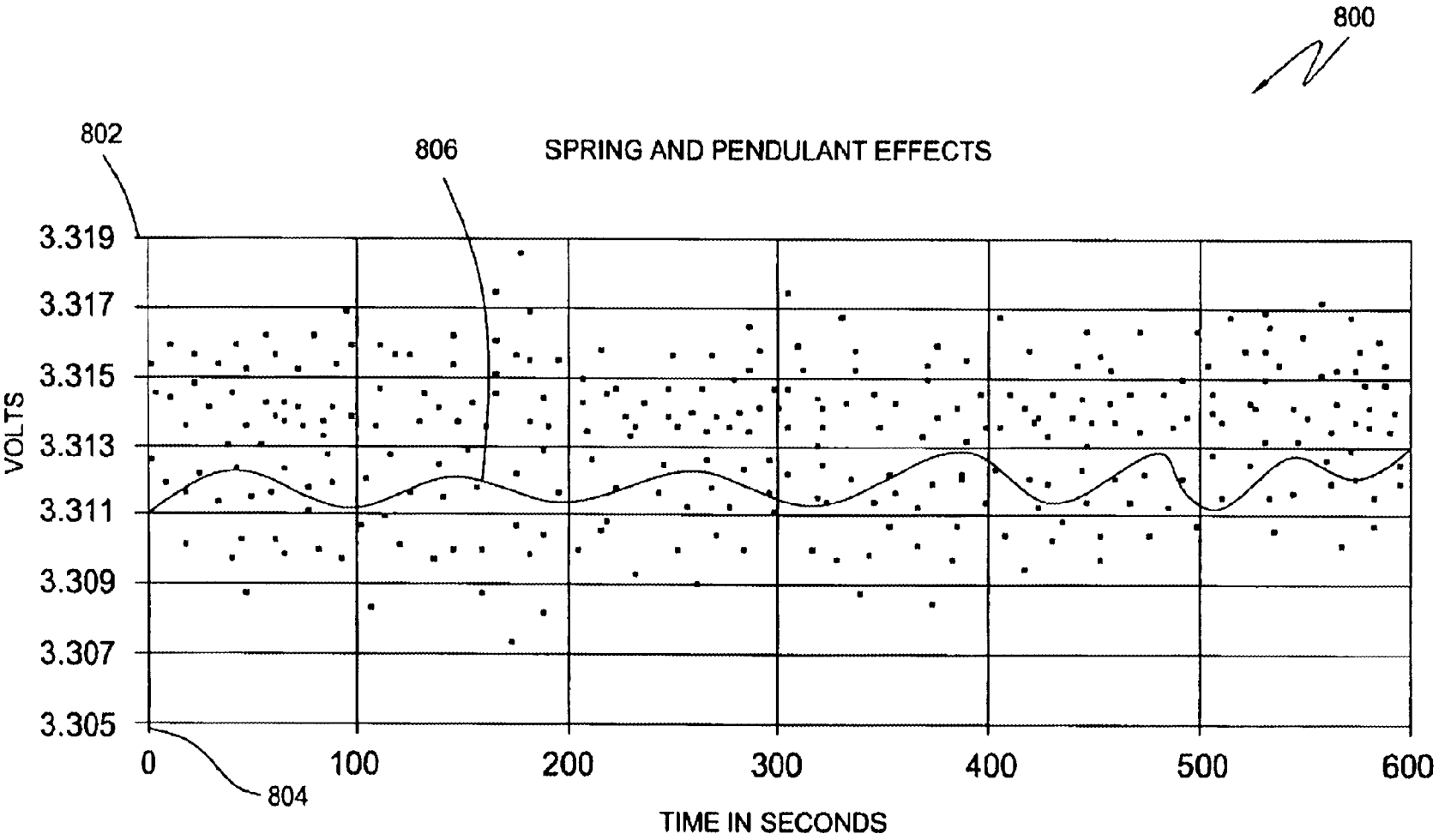
FIG. 8 is a graph illustrating a noise pattern associated with the change in a load cell weight measurement for use with aspects of the invention.

Under normal operating conditions, fluid delivery systems may incur system noise that can impair the accurate measurement of the amount of liquid being delivered. For example, FIG. 5 graphically illustrates system noise as voltage 502 versus time 504 illustrating a noise plot 500 of the system 100 sampled over a period of time, from about one-hundred seconds to about two-hundred seconds. System noise may be averaged as illustrated by average noise plot 506. System noise can include random noise from sources such as vibration of liquids moving through fluid delivery systems, external vibrations, thermal changes, vacuum, impacts, etc., and may include periodic noise from noise sources such as motors. System noise may also include pendulum effect of the hanging vessels 105. Generally, the load cell 150, the vessel 105, and tubing together behave as a spring and pendulum. Once initiated, the pendulum effect may last for an extended period that can affect one or more load cell readings. A pendulum effect depends on many factors including factors such as the amount of liquid in vessel 105, tubing elasticity, the weight of the vessel 105, and system vibration dampening. For example, FIG. 8 illustrates the pendulum effect measured from a hanging vessel 105. In one aspect, a pendulum effect plot 800 may be displayed as a pendulant voltage variation 802 plotted against time 804 using a load cell to measure the pendulum effect. The pendulum effect may be more easily observed with random noise averaged as shown in signal average line 806.

To improve system noise filtering, system response, and liquid delivery accuracy, method 900 may use reference values of measured system noise and pendulum effect. For example, in one aspect, the method 900 stores the average noise plot 506 into a computer memory, for example, for use in calculating system response times and liquid delivery time as described below. While the method 900 may use values of measured system noise and the pendulum effect to help filter system noise, the method 900 may also provide analog signal noise filtering using an active or passive electronic filter (not shown).

Figure 6:
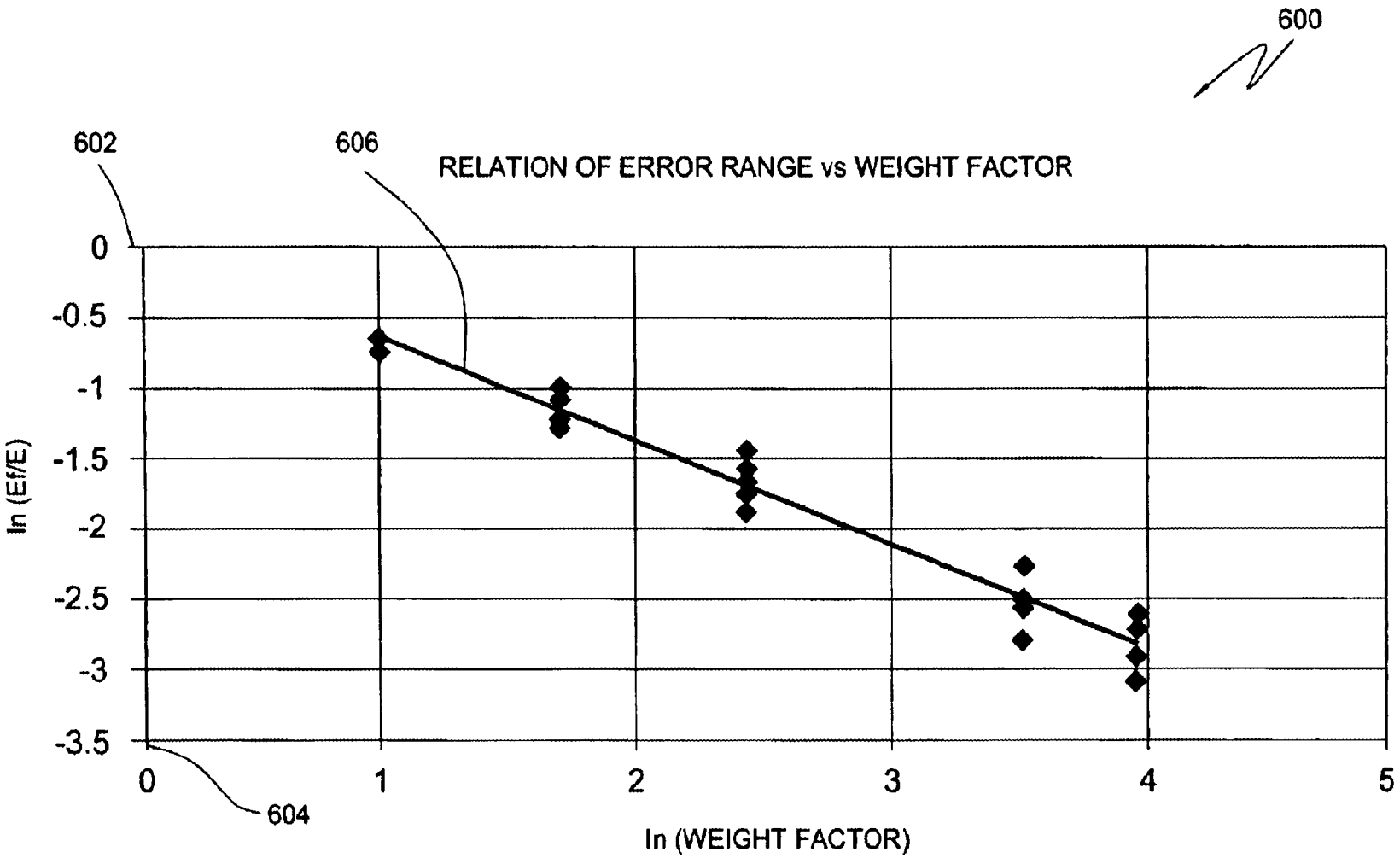
FIG. 6 is a graph illustrating the relationship between a random error range associated with weight factors for use with aspects of the invention.

Referring back to FIG. 9, the method 900 starts at step 902, for example, when provided a request for liquid delivery. At step 904, the method 900 may read the output voltage of a load cell 105 using a method 1000 discussed below with reference to FIG. 10. At step 906, the method 900 calculates the first delivery endpoint and time, and may use calculated and empirical calibration values, such as noise related errors, to optimize the accuracy of the first liquid delivery endpoint. For example, in one aspect, the method 900, may compensate for liquid delivery errors by modeling delivery errors taken over a plurality of previous system response settings. As illustrated in FIG. 6, the ratio 602 (i.e., y-axis) of a filtered signal E with respect to a delivery error $E_f$ is plotted with respect to a weight factor f 604 (i.e., x-axis) to form an average error range plot 606. The weight factor f is defined herein as a system response value that sets the system response time to changes in the weight of vessels. For example, the greater the weight factor f, the less responsive system 100 is to sudden weight changes, noise, etc., but the greater the reading accuracy. The smaller the weight factor f, the greater response of the system 100 but the less reading accuracy. Therefore, a weight factor f may be used as an electronic filter element variable where the response of a fluid delivery system may be adjusted to a plurality of system responses (e.g. first system response, second system response, etc.) in according to a desired accuracy. A weight factor f may be derived both mathematically and empirically and may be used to set a time constant $t_f$ (i.e., response time) of a fluid delivery system during delivery. For example, the time constant may be set using the following equation:

$$t_f(f)=0.1\cdot(f-1) \tag{1}$$

In one aspect, the error range of an adjusted voltage signal $E_f$ of load cells may be determined as a function of weight factor f using the following formula:

$$E_f)=E\cdot f^{-0.7} \tag{2}$$

Figure 7:
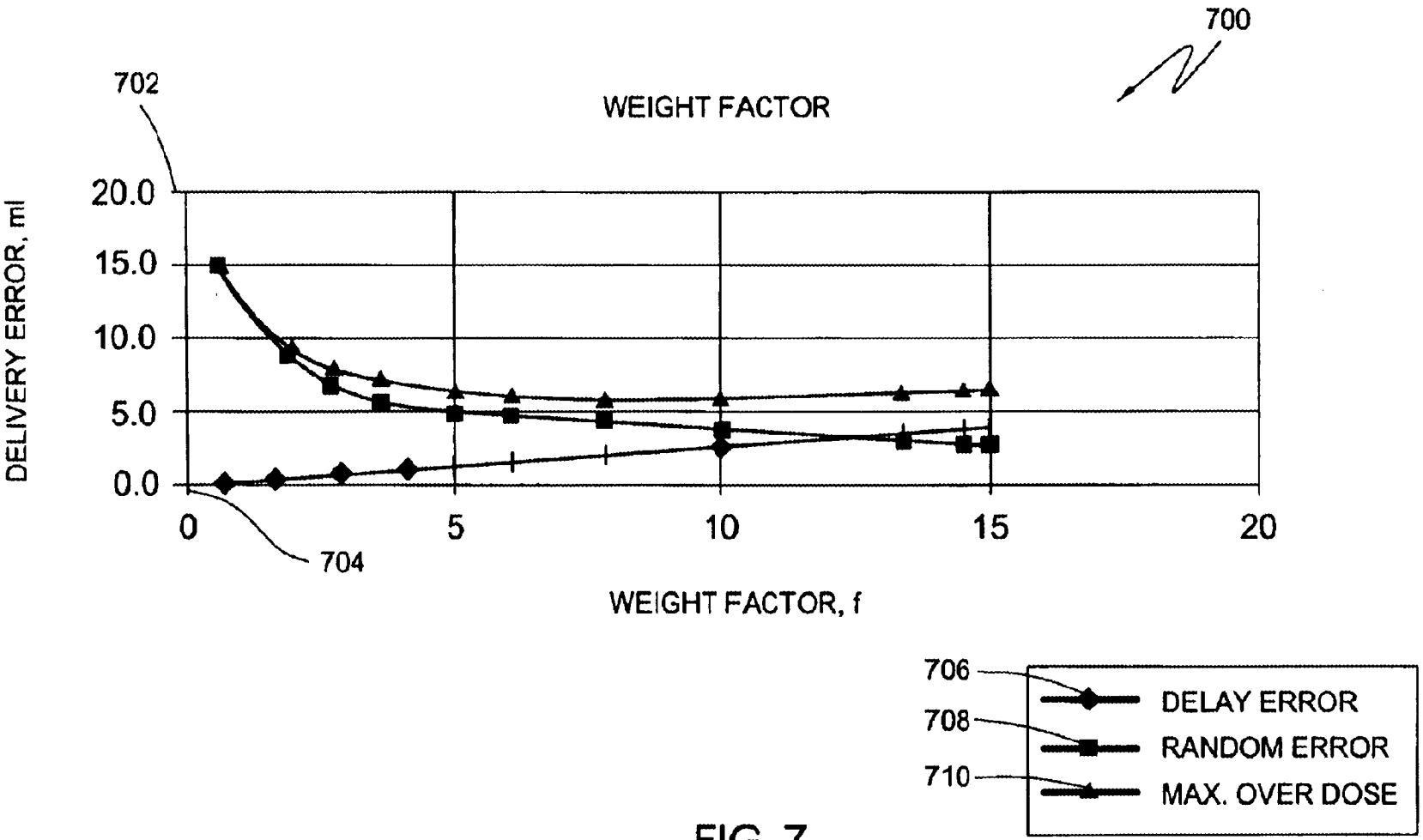
FIG. 7 is a graph illustrating liquid delivery error associated with weight factors for use with aspects of the invention.

In order to achieve satisfactory system performance accuracy, the method 900 may use different weight factors f during delivery than when delivery is stopped (i.e., no liquid delivery). For example, weight factor f may be 51 when the system 100 is stopped to reduce random error, and 5 when the system 100 is delivering liquid to reduce delay error (i.e., system delivery error). In one aspect, weight factor f may be derived as a result of an optimization process to determine an optimal weight factor f. For example, as illustrated in FIG. 7, a weight factor plot 700 may be derived from a liquid delivery delay error 706 related to the signal averaging and a random error 708 related to the system noise. The liquid delivery error 702 is plotted against weight factor values 704. As the value of weight factor f is about 5, the maximum overdose (i.e., maximum delivery overshoot) plot 710 is at about a minimum value. Therefore, weight factor f may be determined to minimize delivery errors and an optimal range for liquid deliver time. For example, as illustrated in FIG. 7, a weight factor f of about 5 provides a minimum amount of error.

Returning to step 906, once a first liquid delivery endpoint has been calculated at step 906, method 900 proceeds to step 910, to determine whether the expected first liquid delivery time is less than a predetermined time limit. The predetermined time limit is a time value predetermined by, for example, an operator to deliver the liquid based on system design criteria. In one aspect, a predetermined time limit corresponds to a minimum time during which a reasonable flow rate can be calculated. For example, in one configuration, a predetermined time limit of a first liquid delivery may be 1 second and the flow rate is 0.180 l/min. If the method 900 calculates a first delivery time to be less than predetermined limit then the method 900 proceeds to step 908, sets second liquid delivery amount equal to the first liquid delivery amount and proceeds to step 932 described below. However, if the calculated first delivery time is greater than a predetermined time limit, then the method 900 proceeds to step 912 described below.

The rate of liquid delivery is measured following the first fluid delivery to adjust for delivery errors, unless the first fluid delivery is skipped, at which event the delivery rate is deduced from the second fluid delivery. In one aspect, delivery flow rate is averaged with a greater requested amount that may carry more weight in an average flow rate calculation. To determine the cumulative liquid delivery used in weight factor calculation, method 900 may use the following formula:

$$M_{new}=M_{old}+m \tag{3}$$

Where $M_{old}$ is the previous cumulative reading, m is the current delivery amount in Kg, and $M_{new}$ is the cumulated liquid delivery amount for calculating the flow rate. The factor w to calculate the delivery flow rate is then calculated using the following formula:

$$w=m/M_{new} \tag{4}$$

The average liquid delivery flow rate R may be calculated by the following equation:

$$R=w^*(m/t_f)+(1-w)^*R_{old} \tag{5}$$

Where $R_{old}$ is the previous average delivery flow rate.

$$M_{store}=\text{Minimum}(M_{new},M_{Max}) \tag{6}$$

$M_{max}$ is a constant to make sure the current request is weighted at least m/$M_{new.\ Mstore}$ will be the $M_{old}$ of the next delivery rate calculation.

Steps 912 through 924 relate to delivering a total fluid amount in one or more delivery amounts. At step 912, the method 900 may set a new system response, i.e., time constant $t_d$, by selecting a new weight factor $f_d$. The new weight factor $f_d$ at step 912, reduces erroneous readings, especially those detected from step 924. At step 914, the method 900 activates a liquid delivery system and delivers the liquid until a first fluid delivery endpoint is detected at step 918. When the first fluid delivery endpoint is detected, fluid delivery is stopped at step 920. At step 922, voltage is read based on a method 1000 discussed in reference to FIG. 10 described below. At step 924, the method 900 determines if the load cell voltage reading is within a range of a maximum signal change rate. The range of maximum signal change rate is a function of filter weight factor, $f_f$, and is defined in equation (2). If the load cell reading exceeds such range, the reading is determined to be a false fluid delivery endpoint, then the method 900 proceeds to step 912 to reset the weight factor $f_t$ to a new value, and resumes fluid delivery. If the load cell reading was within a range of maximum signal change rate, then the method 900 proceeds to step 928 and updates the flow rate.

At step 930, the method 900 determines the delivery amount for a second liquid delivery endpoint based on a remaining liquid amount to be delivered. At step 932, the method 900 determines a second liquid delivery time for the second liquid delivery amount based on previous flow rates. If the calculated second liquid delivery time is less than or equal to a second liquid delivery time threshold, the total amount of fluid delivered from the first delivery is within an acceptable range. The method 900 proceeds to step 940 described below. In one aspect, a second liquid delivery limit at about 0.1 second. If however, at 934 a calculated second delivery time exceeds the second delivery time threshold, then the method 900 delivers the liquid for the second predetermined time at step 936, then measures the load cell voltage at step 938 discussed below with reference to FIG. 10 and calculates a mean delivery overshoot at step 940. The method 900 exits at step 942.

Figure 10:
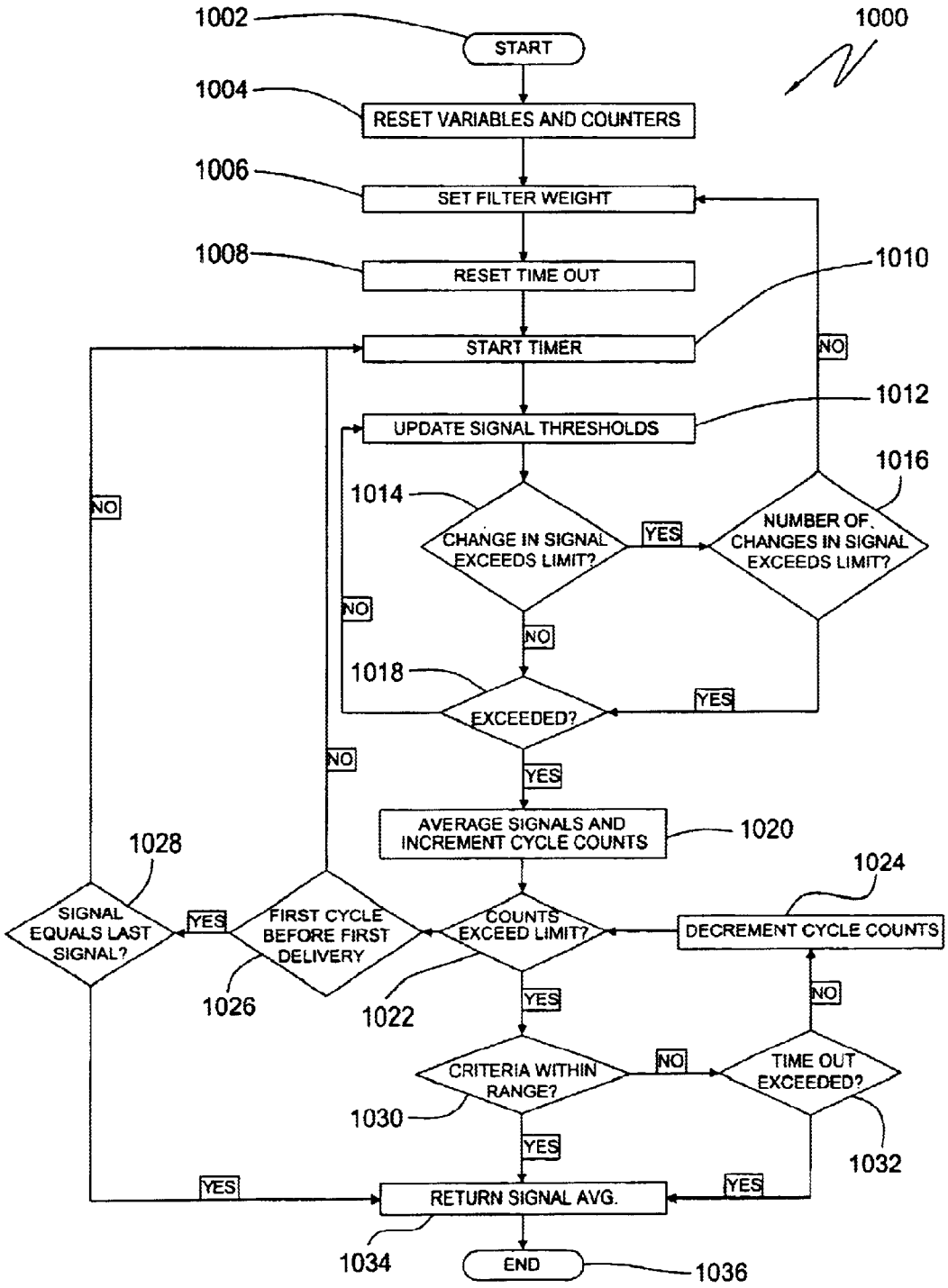
FIG. 10 is a flow diagram illustrating one embodiment of a signal reading process for use with aspects of the invention.

FIG. 10 is a flow diagram of one embodiment of a method 1000 that may be used to determine a load cell reading for the liquid delivery system in a non-delivery state. FIGS. 5–9 are referenced as needed in the discussion of FIG. 10. Method 1000 measures the voltage or current of load cells 150 when no liquid depletion or addition takes place inside vessel 105. However, as system noise may interfere with the load cell measurement, method 1000 utilizes one or more readings and voltage/current threshold limits to determine an average reading.

Specifically, the method 1000 starts at step 1002, for example, when the method 900 (see FIG. 9) invokes voltage reading steps 904, 922, or 938. At step 1004, the method 1000 resets system variables and counters and may wait a period of time before taking measurements to allow a fluid delivery system to settle. In one aspect, a period of time is a function of the time constant $t_f$ being used. At step 1006, the weight factor f is set to establish a fixed signal weight factor $f_f$. The fixed signal weight factor $f_f$ is defined herein as a load cell reading during fixed load cell condition, i.e. the load cell condition when it is not currently delivering or being refilled by liquid. In one aspect, the fixed signal weight factor $f_f$ is set as high as possible to provide a more accurate voltage reading but still a reasonable response delay. To ensure that the load cell voltage readings are given a desired time limit at step 1008, the method 1000 resets the measurement time limit (e.g. timeout). In one aspect, a timeout is determined based on a length of time a measurement should occur, e.g. 1 minute. At step 1010, the method 1000 starts counting the time for each measurement. At step 1012, the voltage measurement thresholds are updated and the method 1000 proceeds to measure the voltage of a load cell. At step 1014, if a voltage measurement jump is counted, the method 1000 proceeds to step 1016 to test whether or not the voltage jump counts have been exceeded a predetermined number of times. In one aspect, a voltage jump is defined as a change in voltage measurement larger than the random noise. If the voltage measurements have not exceeded the voltage limits at step 1014, then method 1000 proceeds to step 1018 to determine if the measurement time has been exceeded. If the measurement time has not been exceeded, then the method 1000 proceeds to step 1012. If the measurement time has been exceeded, then the method 1000 at step 1020 averages the measurement and increments the cycle counter by one count, to count the number of measurements. At step 1022, the method 1000 determines, using a number of measurement counts, if the number of voltage averaging periods have exceeded a predetermined count limit (e.g., 5). If the number of averaging periods have not exceeded the predetermined count limit then the method 1000 proceeds to step 1026 to determine if the measurement is the first measurement in a delivery process. If the measurement is not the first measurement, then the method 1000 proceeds to step 1010 to restart the timer for the next measurement. If at step 1026 the measurement is the first measurement, then the method 1000 proceeds to step 1028 to determine if the current signal measurement is equal to the last measurement from the last liquid delivery. If the current signal measurement is equal to the last measurement from the last liquid delivery, then the method 1000 proceeds to step 1034 described below. If the current signal measurement is not equal to the last measurement from the last liquid delivery then the method 1000 proceeds to step 1010 to restart the time for the next measurement. If at step 1022 the number of measurements have exceeded the predetermined count limit then the method 1000 proceeds to step 1030 to determine if the signal measurements are within a desired range. If the signal measurements are within a desired range then the method 1000 proceeds to step 1034 to return an average signal value. If the signal measurements are not within a desired range, then the method 1000 proceeds to step 1032 to see if an overall measurement time (i.e., timeout) has expired. If the overall measurement time has expired then the method 1000 proceeds to step 1034 and then exits at step 1036. If the overall measurement time has not expired, then the method 1000 proceeds to step 1024 to decrement the cycle counts by one and then proceeds to step 1022. Thus, using the average voltage/current value method 1000 provides an average measurement weight value to the system 100.

while the foregoing is directed to embodiments of the invention, other and further embodiments of the invention may be devised without departing from the basic scope thereof, and the scope thereof is determined by the claims that follow.

What is claimed is:

1. An apparatus for delivering liquids to substrate processing systems, comprising a plurality of load cells extending from a frame, each of the plurality of load cells adapted to output signals corresponding to liquid input and output of the apparatus;

a plurality of free hanging vessels, each of the free hanging vessels suspended from one of the plurality of load cells, each of the plurality of free hanging vessels including at least one gas input, at least one liquid input, and at least one liquid outlet; and at least one vibration dampener disposed between each of the plurality of load cells and each of the plurality of free hanging vessels hanging therefrom, to minimize the transmission of vibration therebetween.

2. The apparatus of claim 1, further comprising tubing adapted to fluidly couple liquids to and from the plurality of free hanging vessels, wherein the tubing includes at least one of a flexible structure, a wall thickness, and a diameter sized to minimize vibration transmission therethrough.

3. The apparatus of claim 1, further comprising a weight holder disposed on at least one of the plurality of free hanging vessels to support a weight to calibrate at least one of the plurality load cells in communication therewith.

4. The apparatus of claim 1, further comprising a plurality of isolation supports disposed between the frame and a support surface adapted to hold the frame thereon.

5. The apparatus of claim 1, wherein the frame is adapted to allow the plurality of free hanging vessels vertical movement while limiting horizontal movement of the free hanging vessels with respect to the frame.

6. The apparatus of claim 1, wherein at least one of the plurality of free hanging vessels comprise a liquid level monitor adapted to allow for visual inspection of the liquid level contained therein.

7. The apparatus of claim 1, further comprising a controller adapted to receive and process the signals from the plurality of load cells.

8. A liquid delivery system adapted to deliver one or more liquids to substrate processing systems, comprising:

a plurality of free hanging vessels vibrationally isolated from a frame;

a plurality of load cells disposed on the frame, each of the plurality of load cells having one of the plurality of free hanging vessels suspended therefrom, wherein each of the plurality of load cells is adapted to output one or more signals corresponding to a weight of the respective free hanging vessel attached thereto;

at least one vibration dampener positioned between the frame and each of the plurality of load cells to isolate vibration transmission therebetween; and a controller electrically coupled to the plurality of load cells and adapted to process the one or more signals therefrom to control the liquid flow of the liquid delivery system.

9. The system of claim 8, further comprising a plurality of tubing coupled to the plurality of free hanging vessels adapted to minimize vibration transmission and conduct liquid flow to and from the plurality of free hanging vessels.

10. The system of claim 8, further comprising a vacuum apparatus fluidly coupled to at least one gas inlet of each plurality of free hanging vessels and adapted to provide a sub-ambient air pressure therein.

11. The system of claim 8, further comprising a weight holder disposed on each of the plurality of free hanging vessels to support a weight to calibrate one of the plurality of load cells in communication therewith.

12. The system of claim 8, wherein the vacuum apparatus comprises a venturi.

13. The system of claim 8, wherein the vessels comprise a liquid level monitor adapted to allow the visual inspection of liquid levels.

14. A method of delivering liquids to a substrate processing system, comprising:

determining a total fluid amount to deliver;

determining a first system response to compensate for system noise during liquid delivery;

determining a first liquid amount to deliver from at least one of a plurality of vessels fluidly coupled to the substrate processing system, wherein the first liquid amount to deliver corresponds to a first deliver time associated with a delivery rate and the first system response;

delivering the first liquid amount to the substrate processing system;

determining a second liquid amount to deliver to the substrate processing system based on the first liquid amount delivered thereto and the delivery rate, wherein the second liquid amount delivered corresponds to a second delivery time; and delivering the second liquid amount to the substrate processing system, wherein the summation of the first liquid amount delivered and the second liquid amount delivered is within a range of the total fluid amount.

15. The method of claim 14, wherein determining the first system response comprises determining a delivery error for the first delivery amount.

16. The method of claim 15, wherein delivering the first liquid amount comprises compensating for the delivery error by adjusting delivery parameters to compensate for at least one of system noise, delay error, an error history of a plurality of previous liquid deliveries, and combinations thereof.

17. The method of claim 14, wherein determining the first liquid amount comprises measuring at least one signal from the load cell during the first liquid delivery time responsive to a change in weight of a vessel.

18. The method of claim 17, wherein if a first liquid delivery end point has been reached then determining if a weight rate of change exceeds a threshold value, if the weight rate of change exceeds the threshold value then continuing to deliver the first liquid delivery amount until the liquid delivery is within a range of the first liquid delivery amount.

19. The method of claim 14, wherein determining the first liquid amount comprises measuring a delivery amount for the first liquid, wherein if the delivery amount outside a range of a threshold delivery amount then determining a new delivery time.

20. The method of claim 19, wherein determining the new delivery time comprises determining a second system response.

21. The method of claim 14, wherein determining the second liquid amount comprises measuring a signal from the load cell indicative of a vessel weight before and after the second liquid delivery.

22. The method of claim 21, further comprising averaging the signal using a weight factor, wherein the weight factor dynamically changes at least one of the first system response or second system response.

23. The method of claim 21, wherein determining the second delivery amount comprises determining delivery accuracy by delivering a liquid for a calculated time based on an averaged delivery rate of the first liquid delivery and measuring the amount of liquid delivered after the second liquid delivery.

24. The method of claim 14, wherein determining a first system response further comprises determining at least one of random error and delay error.

25. The method of claim 24, wherein determining delivery accuracy further comprises determining delivery error contributed by at least one of the random error and the delay error.

26. A method of delivering liquids from liquid sources to one or more substrate processing systems using a liquid delivery apparatus, comprising:

providing at least one signal to a controller from a load cell corresponding to a weight of the vessel;

processing the at least one signal to determine a first system response; the first system response based on at least one of system noise and a system delivery error during liquid delivery;

delivering a first liquid amount for a first delivery time at a delivery rate; and delivering a second liquid amount for a second delivery time based on the first liquid amount delivered, wherein the first liquid amount delivered and second liquid amount delivered total to within a range of a specified liquid delivery amount.

27. The method of claim 26, further comprising coupling liquids to the liquid delivery apparatus using tubing adapted to minimize vibration transmission during liquid delivery to the substrate processing systems.

28. The method of claim 26, wherein the load cell is coupled to at least one vibration dampener disposed between a frame and the load cell.

29. The method of claim 26, wherein delivering the first liquid amount comprises measuring at least one, signal from the load cell during the first liquid delivery time responsive to a change in weight of the vessel.

30. The method of claim 26, wherein delivering the second liquid amount comprises measuring at least one signal from the load cell before and after the second liquid delivery.

31. The method of claim 26, wherein prior to delivering the second amount, if the second delivery time is less than a threshold value then stopping delivery.

32. The method of claim 26, further comprising prior to determining the first system response, determining an average load cell signal reading.

33. The method of claim 32, wherein the system noise includes random noise, periodic noise, load cell signal fluctuations, and combinations thereof.

34. The method of claim 32, wherein determining the average load cell signal comprises determining if the system noise is within a desired range during liquid delivery.

35. The method of claim 32, wherein determining the average load cell signals comprises determining if the system noise is within a desired range before and after liquid delivery.

36. The method of claim 32, wherein determining the first system response comprises determining a sampling rate of the at least one load cell signal to compensate for at least a portion of the system noise from at least one signal measurement from the load cell corresponding to the weight of the vessel.

37. The method of claim 26, wherein delivering the first liquid amount comprises measuring the at least one signal from the load cell during the first liquid delivery time.

38. The method of claim 37, wherein if the change in the at least one signal exceeds a threshold value then determining if the first liquid amount is within a delivery range.

39. The method of claim 37, wherein if the liquid amount has exceeded the range then determining a new system response.

40. The method of claim 26, wherein delivering the second liquid amount comprises measuring the at least one signal from the load cell before and after the second liquid delivery.

41. The method of claim 40, wherein if the change in the at least one signal exceeds a threshold value then determining if the second liquid amount is within a delivery range.

42. The method of claim 40, wherein the second delivery amount is based on the second delivery time calculated from an averaged delivery rate of the first liquid delivery and a delivery amount remaining after the first liquid delivery.

* * * * *

UNITED STATES PATENT AND TRADEMARK OFFICE

CERTIFICATE OF CORRECTION

PATENT NO. : 6,752,547 B2
APPLICATION NO. : 10/282770
DATED : June 22, 2004
INVENTOR(S) : Eric B. Britcher et al.

It is certified that error appears in the above-identified patent and that said Letters Patent is hereby corrected as shown below:

Title Page - add
References Cited – U.S. Patent Documents

Insert:

| | | |
|---|---|---|
| 5,409,310 | 4/1995 Owczarz | 366/136 |
| 5,490,611 | 2/1996 Bernosky, et al. | 222/1 |
| 6,091,498 | 7/2000 Hanson, et al. | 356/375 |
| 6,098,843 | 8/2000 Soberanis, et al. | 222/53 |
| 6,203,582 B1 | 3/2001 Berner, et al. | 29/25.01 |
| 6,269,975 B2 | 8/2001 Soberanis, et al. | 222/1 |
| 6,270,635 B1 | 8/2001 Woo | 204/237 |
| 6,333,275 B1 | 12/2001 Mayer, et al. | 438/745 |
| 6,340,098 B2 | 1/2002 Soberanis, et al. | 222/56 |
| 6,436,249 B1 | 8/2002 Patton, et al. | 204/212 |

Column 2

Line 61, replace “deliver” with --delivery--;

Column 5

Line 24, replace “dear” with --clear--;

Line 31, replace “dear” with --clear--;

Column 6

Line 5, replace “deliver” with --delivery--;

Line 14, replace “an” with --and--;

Column 7

Line 24, delete “,”;

Column 8

Line 21, replace “darity” with --clarity--;

UNITED STATES PATENT AND TRADEMARK OFFICE

CERTIFICATE OF CORRECTION

PATENT NO. : 6,752,547 B2
APPLICATION NO. : 10/282770
DATED : June 22, 2004
INVENTOR(S) : Eric B. Britcher et al.

It is certified that error appears in the above-identified patent and that said Letters Patent is hereby corrected as shown below:

Column 9

Line 41, should read --$E_f(f) = E \cdot f^{-0.7}$--;

Line 60, replace "deliver" with --delivery--;

Column 10

Line 42, replace "$_{Mstore}$" with --$M_{store}$--;

Column 13

Line 49, replace the second occurrence of "deliver" with --delivery--;

Column 15

Line 2, delete ",".

Signed and Sealed this

Thirteenth Day of February, 2007

JON W. DUDAS
*Director of the United States Patent and Trademark Office*